US006058710A

United States Patent [19]

Brehm

[11] Patent Number: 6,058,710

[45] Date of Patent: May 9, 2000

[54] AXIALLY STAGED ANNULAR COMBUSTION CHAMBER OF A GAS TURBINE

[75] Inventor: Norbert Brehm, Stahnsdorf, Germany

[73] Assignee: BMW Rolls-Royce GmbH, Oberursel, Germany

[21] Appl. No.: 08/913,123

[22] PCT Filed: Mar. 4, 1996

[86] PCT No.: PCT/EP96/00895

§ 371 Date: Sep. 8, 1997

§ 102(e) Date: Sep. 8, 1997

[87] PCT Pub. No.: WO96/27766

PCT Pub. Date: Sep. 12, 1996

[30] Foreign Application Priority Data

| | | | |
|---|---|---|---|
| Mar. 8, 1995 | [DE] | Germany | 195 08 109 |
| Jan. 12, 1996 | [DE] | Germany | 196 00 837 |

[51] Int. Cl.[7] ..... F02C 7/22

[52] U.S. Cl. ..... 60/747

[58] Field of Search ..... 60/746, 747, 39.36

[56] References Cited

U.S. PATENT DOCUMENTS

| | | |
|---|---|---|
| Re. 33,896 | 4/1992 | Maghon et al. . |
| 3,701,255 | 10/1972 | Markowski . |
| 3,747,345 | 7/1973 | Markowski . |
| 3,788,065 | 1/1974 | Markowski . |
| 3,792,582 | 2/1974 | Markowski . |
| 3,811,277 | 5/1974 | Markowski . |
| 3,872,664 | 3/1975 | Lohmann et al. . |
| 3,879,939 | 4/1975 | Markowski . |
| 3,919,840 | 11/1975 | Markowski . |
| 3,930,370 | 1/1976 | Markowski et al. . |
| 3,937,008 | 2/1976 | Markowski et al. . |
| 3,973,395 | 8/1976 | Markowski et al. . |
| 3,974,646 | 8/1976 | Markowski et al. . |
| 4,045,956 | 9/1977 | Markowski et al. . |
| 4,058,977 | 11/1977 | Markowski et al. . |
| 4,194,358 | 3/1980 | Stenger . |

(List continued on next page.)

FOREIGN PATENT DOCUMENTS

| | | |
|---|---|---|
| 24 12 120 | 3/1974 | Germany . |
| 43 44 274 | 6/1995 | Germany . |
| 2 010 407 | 6/1979 | United Kingdom . |
| 2 010 408 | 6/1979 | United Kingdom . |
| WO 93/25851 | 12/1993 | WIPO . |

OTHER PUBLICATIONS

Japanese Abstract No. 58–47928, vol. 7, No. 133 (M–221) (1278), Jun. 10, 1983.

*Primary Examiner*—Charles G. Freay

*Attorney, Agent, or Firm*—Evenson, McKeown, Edwards & Lenahan, PLLC

[57] ABSTRACT

An axially stepped annular combustion chamber, especially of an aircraft gas turbine, has an essentially independent main combustion chamber 5' as well as an independent pilot burner chamber 5. An appropriate design of internal limiting walls **6*a*, 6*b* of pilot burner chamber 5 ensures that the combustion gases enter the main burner zone 5' essentially in the radial direction. This ensures optimum mixing of the fuel with air in this main combustion zone and/or main combustion chamber 5', thus minimizing exhaust emissions and ensuring optimum temperature distribution at combustion chamber outlet 8. Internal limiting wall 6*a* can have a deflecting section 12 or outer wall section 6*b* can run at an angle to pilot burner lengthwise axis 3*a*, so that the cross section of pilot burner zone 5** is reduced in the flow direction.

21 Claims, 3 Drawing Sheets

U.S. PATENT DOCUMENTS 4,246,758 1/1981 Caruel et al. .
4,265,615 5/1981 Lohmann et al. .
4,389,848 6/1983 Markowski et al. .
4,903,492 2/1990 King .
5,036,657 8/1991 Seto et al. .
5,099,644 3/1992 Sabla et al. .
5,197,278 3/1993 Sabla et al. .
5,197,289 3/1993 Glevicky et al. .
5,220,795 6/1993 Dodds et al. .
5,279,126 1/1994 Holladay .
5,285,635 2/1994 Savelli et al. .
5,323,605 6/1994 Roberts, Jr. et al. .
5,402,634 4/1995 Marshall ..... 60/39.06
5,406,799 4/1995 Marshall .
5,490,380 2/1996 Marshall .
5,592,821 1/1997 Alary et al. ..... 60/751
5,862,668 1/1999 Richardson ..... 60/737

AXIALLY STAGED ANNULAR COMBUSTION CHAMBER OF A GAS TURBINE

This application is a 371 of PCT/EP96/00895 filed Mar. 4, 1996.

BACKGROUND AND SUMMARY OF THE INVENTION

The invention relates to an axially staged annular combustion chamber of a gas turbine with a central axis, and with a plurality of pilot burners located between annular wall sections, as well as with main burners that terminate in the combustion chamber downstream from and radially outside the pilot burners. A main burner zone abuts the main burners. The combustion chamber includes an outer and an inner combustion chamber wall, each annular in shape. Each of the walls extends up to the combustion chamber outlet, with the inner combustion chamber wall having a wall section that runs essentially parallel to the pilot burner axis in the area of the pilot burner zone.

Regarding known prior art, reference is made for example to WO 93/25851 (having a U.S. equivalent in U.S. Pat. No. 5,406,799) or German Patent document DE-OS 28 38 258, but especially to GB-A-2 010 408 (having a U.S. equivalent in U.S. Pat. No. 4,194,358), showing an axially staged annular combustion chamber in which the combustion gases of the pilot burner zone are conducted by an appropriate design, especially of the inner combustion chamber wall, into the main burner zone.

The goal of the present invention is to improve an axially staged annular combustion chamber of the above-mentioned type, especially in regard to the mixing of the pilot burner gases with the main burner gases and thus to the exhaust emissions and/or the temperature distribution in the vicinity of the combustion chamber outlet.

To achieve this goal, provision is made such that the inner combustion chamber wall, adjoining the inner wall section that forms the pilot burner zone and essentially also runs parallel to the central axis, has a deflecting section that is convex-concave in shape. The deflecting section runs toward the main burner zone as viewed looking downstream, i.e. as viewed from inside the combustion chamber. The deflecting section, viewed in the radial direction relative to the central axis, extends approximately at the level of the outer pilot burner wall section. The deflecting section is abutted by a wall section that leads to the combustion chamber outlet and runs essentially parallel to the central axis.

An additional measure consists in that the outer wall section of the pilot burner zone that faces the main burner runs at an angle to the lengthwise axis of the associated pilot burner, so that the cross section of the pilot burner zone decreases in the flow direction. Advantageous improvements and embodiments are described herein.

The invention will now be described in greater detail with reference to two preferred embodiments as shown in the drawings.

DETAILED DESCRIPTION OF THE DRAWINGS

Figure 1:
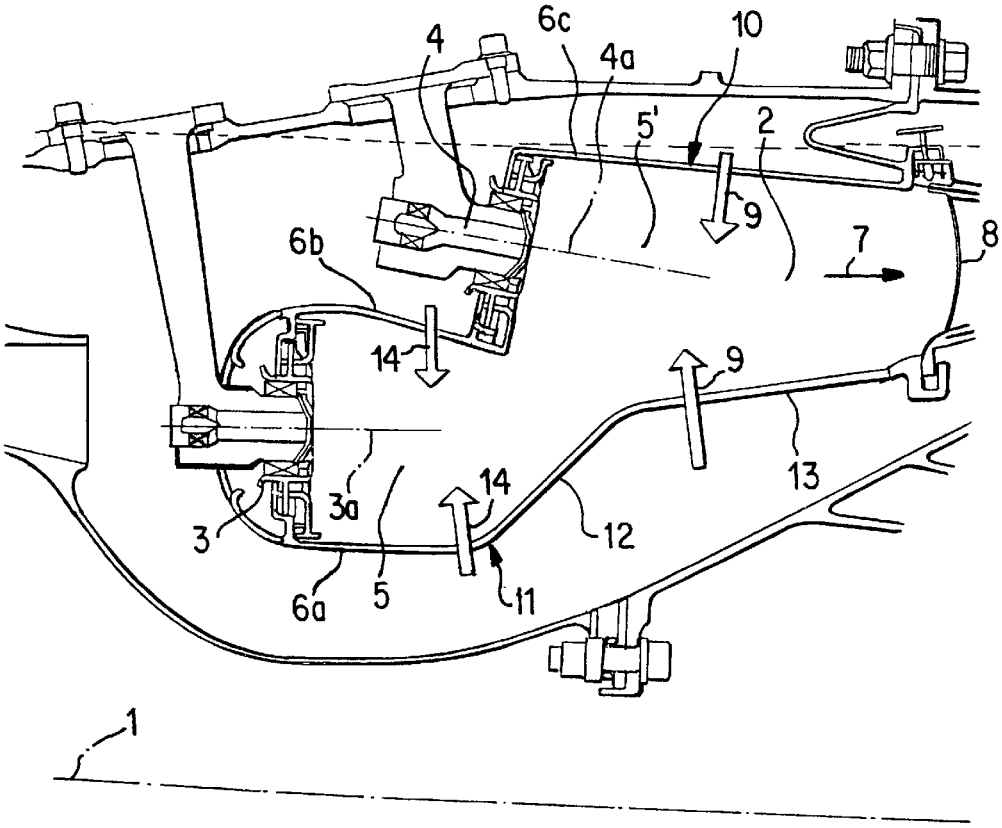
FIG. 1 shows a partial lengthwise section through an annular combustion chamber according to the invention.
Figure 2:
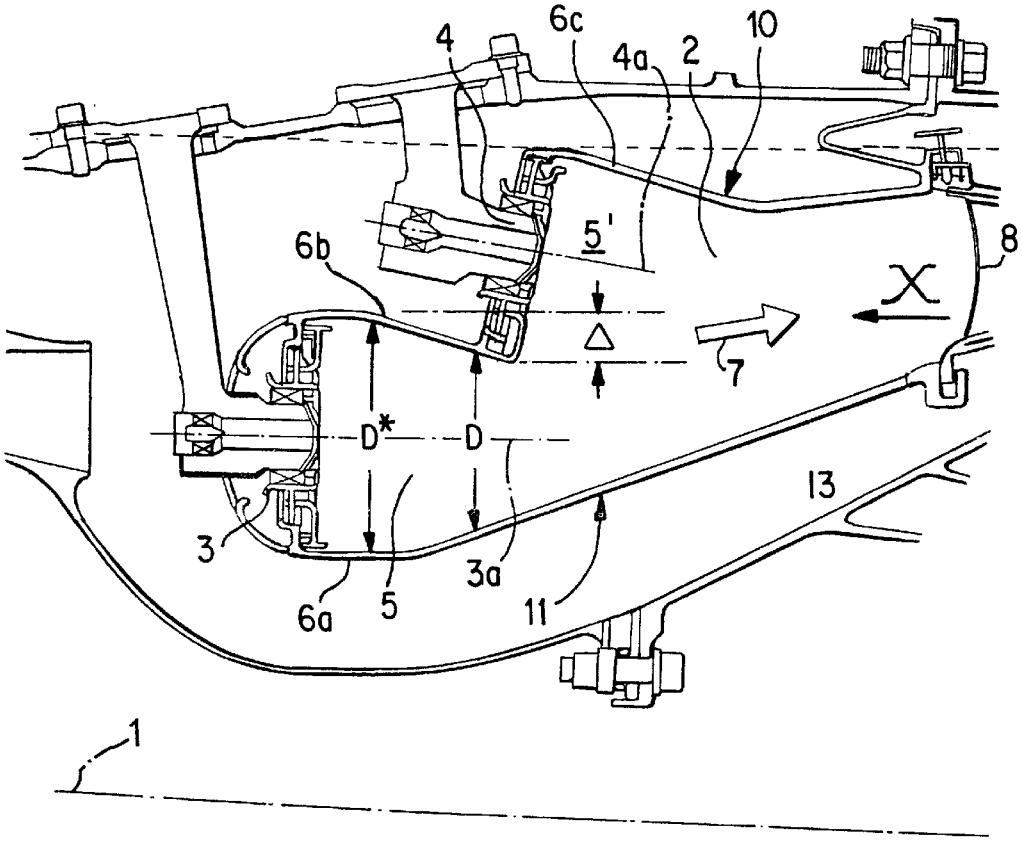
FIG. 2 shows a partial lengthwise section through an annular combustion chamber according to the invention.

Referring to FIGS. 1 and 2, reference number 1 indicates the central axis of a basically known annular combustion chamber 2, especially an aircraft gas turbine. A plurality of pilot burners 3 as well as several main burners 4 are located in annular combustion chamber 2, distributed around its circumference. Main burners 4 as usual are arranged externally in the radial direction and, in one preferred embodiment, can have their lengthwise axes or main burner axes 4*a* inclined with respect to lengthwise axes 3*a* of pilot burners 3, in other words, inclined relative to so-called pilot burner axes 3*a*. The main burners 4 located in the radial direction outside pilot burners 3 thus terminate in combustion chambers 2 downstream from pilot burners 3. A so-called pilot burner zone 5 adjoins pilot burners 3 while a so-called main burner zone 5' is formed directly downstream of main burners 4.

The entire combustion chamber 2, in other words the unit composed of pilot burner zone 5 and main burner zone 5', is delimited by an external annular combustion chamber wall 10 and is delimited from central axis 1 by an internal combustion chamber wall 11. Wall 11 consists of individual so-called wall sections, namely of an inner wall section 6*a* associated with pilot burner zone 5 and, in the embodiment shown in FIG. 1, of an adjoining so-called deflecting section 12. In both embodiments, the wall 11 consists of a wall section 13 that leads to combustion chamber outlet 8 (outlet 8 can also be referred to as combustion chamber end 8). Pilot burner zone 5 is delimited externally in the radial direction by an outer wall section 6*b* that extends up to main burner 4. Outer wall section 6*b* is adjoined by main burner or burners 4, with each main burner 4 or each main burner axis 4*a* being arranged at an angle to the pilot burner axis 3*a* of each pilot burner 3, as is clearly shown. Downstream, far outside the combustion chamber, the two lengthwise axes 3*a*, 4*a* of burners 3, 4 would intersect, while lengthwise axis 3*a* is aligned essentially parallel to central axis 1. However, this arrangement only relates to the embodiments shown here; of course, it would also be possible to arrange the individual lengthwise axes 3*a*, 4*a* of pilot burners 3 and/or main burners 4 differently (parallel to one another, for example). In addition, pilot burners 3 and main burners 4 do not necessarily have to be in a common lengthwise section plane as shown here, but pilot burner 3 and main burner 4 can also be arranged staggered with respect to one another in the circumferential direction. Moreover, the flow direction of the combustion gases in combustion chamber 2 is also indicated by arrow 7.

In addition, a further outermost wall section 6*c* of the outer annular combustion chamber wall 10 is provided between main burner 4 and combustion chamber outlet 8.

The primary point of importance here is the pattern of the internal combustion chamber wall 11. This wall, in the embodiment shown in FIG. 1, has a deflecting section 12 that runs toward main burner zone 5', abutting wall section 6*a* that forms pilot burner zone 5. This deflecting section 12 is aligned at least partially in the radial direction (this is defined as being perpendicular to central axis 1), i.e. deflecting section 12 intersects central axis 1 in the embodiment shown here at an angle of approximately 45° for example. This means that the combustion gases from pilot burners 3, guided by this deflecting section 12, enter main burner zone 5' essentially in the radial direction. This shape of internal combustion chamber wall 11 can also be described specifically by saying that this combustion chamber wall 11 is concave-convex in shape in the area of deflecting section 12 as well as relative to combustion chamber 2, in other words as viewed from the interior of the combustion chamber, looking downstream (namely in flow direction 7). This means that, starting at wall section 6*a*, a concave curvature is initially provided in deflecting section 12, which is abutted by a wall section 13 with a convex curvature that leads to combustion chamber outlet 8. This design ensures optimum mixing of the fuel that enters main burner zone 5' through main burner 4 with air in main burner zone 5'. As a result, the exhaust emissions are minimized and the temperature distribution at combustion chamber outlet 8 can be matched with that from a non-stepped combustion chamber.

An additional measure for achieving a better mixture of the pilot burner gases with the main burner gases is shown in FIG. 2, where for the sake of simplicity the deflecting section according to the invention, designated by reference number 12 in FIG. 1, is not shown.

In FIG. 2, outer wall section 6*b* of pilot burner zone 5, facing main burner 4, is inclined relative to lengthwise axis 3*a* of associated pilot burner 3 in such fashion that the cross section D of pilot burner zone 5 is decreased in the flow direction, in other words from pilot burner 3 in the direction of arrow 7 toward the center of combustion chamber 2. This means that the main burner 4 is immersed in, or penetrates, pilot burner zone 5 so to speak, as is especially apparent from FIG. 2 in the form of a so-called penetration depth Δ.

This reduction in the cross section D of pilot burner zone 5 and/or this penetration of main burner 4 into pilot burner zone 5 firstly produces an especially good mixing of the main burner gases with the gases of pilot burner 3, since the latter undergo an advantageous change in their flow field. The pilot burner gases are vorticized to a greater degree by outer wall section 6*b* and are additionally accelerated by the reduction in cross section. Improved mixing at the center of combustion chamber 2 with the gas flows emitted from main burner 4 therefore results.

In addition, the axially staged annular combustion chambers 2 according to the invention described here can also be referred to basically as an assembly of two independent non-stepped annular burners. This means that both main burner zone 5' and pilot burner zone 5 each exhibit the design features of non-stepped annular combustion chambers and therefore are optimized for the upper load range (for main burner zone 5') and for the lower load range (for pilot burner zone 5) of the gas turbine. As can be seen, main burner zone 5' located outward is designed in the same way as a conventional non-stepped annular combustion chamber, with main burner axis 4*a* essentially pointing in the direction of the combustion chamber axis or coinciding therewith. In addition, streams of mixed air 9 are added and mixed in main burner zone 5' and in annular combustion chamber 2 on both sides, in other words, from inside and from outside (this is only shown in FIG. 1) as is usual in conventional annular combustion chambers. In addition, in this (conventional) annular combustion chamber 2, a coupled pilot burner zone 5 is also provided, i.e. a sort of separate pilot burner chamber that is located radially inward as well as upstream from main burner zone 5'. In order to be able to conduct the combustion gases from this pilot burner chamber or pilot burner zone 5 optimally into main burner zone 5' and thus permit optimum mixing of fuel and air in said zone 5', an effort can be made to ensure that the combustion gases from the pilot burner chambers enter main burner zone 5' and/or the corresponding main burner chambers essentially in the radial direction. This radial direction determination takes place in FIG. 1 as a result of the so-called deflecting section 12 of inner annular combustion chamber wall 11, while in FIG. 2 the pilot burner gases undergo increased vorticization as a result of the change in the flow field and are accelerated toward the main burner gases.

Figure 3:
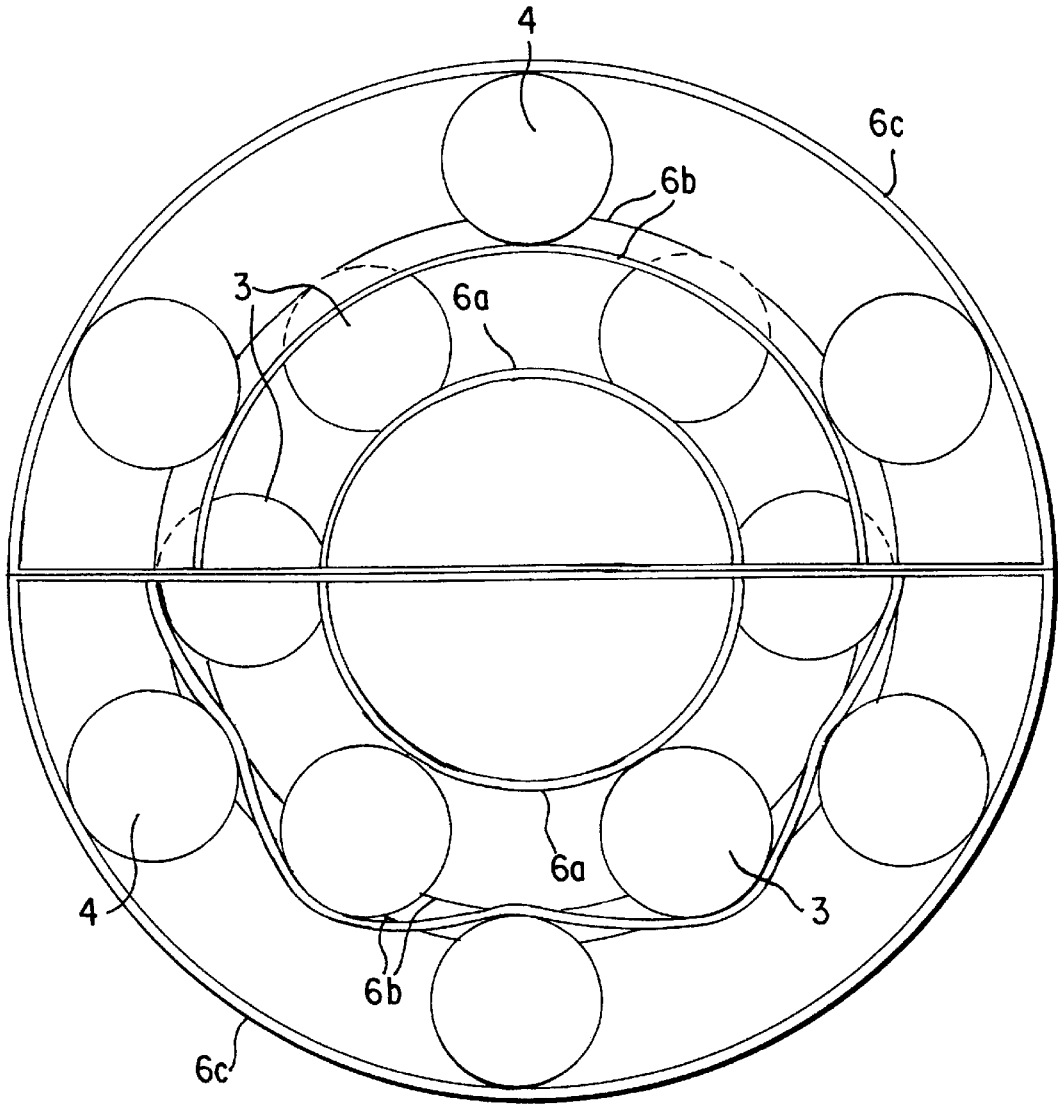
FIG. 3 shows two possible partial cross sections through an annular combustion chamber according to the invention.

Advantageously, especially with the design of annular combustion chamber 2 that is shown and described in FIG. 2, an extremely compact form is also achieved, i.e. the diameter of an annular combustion chamber of this type and/or its so-called structural height can be minimized as a result. This leads to favorable conditions when the value of the penetration depth Δ relative to the cross section D* of pilot burner zone 5 in the area of pilot burners 3 lies in the range from 0.1 to 0.3, in other words, $0.1 \leqq \Delta/D^* \leqq 0.3$. The compact design is further promoted by the staggered arrangement, shown in FIG. 3 as well, of pilot burners 3 as well as main burners 4. Then there is, so to speak, a pilot burner 3 between each two main burners 4.

FIG. 2 also shows that inside wall section 6*a* of pilot burner zone 5 can run at an angle in its end area relative to pilot burner lengthwise axis 3*a*, so that outer wall section 6*b* as well as inner wall section 6*a* run together, so to speak, in the end areas of said sections. Once again, this causes a desired reduction in the cross section of pilot burner zone 5, with this slope of the inner combustion chamber wall 11 being able to continue with essentially the same orientation up to combustion chamber end 8, and thus, with the same orientation, limiting the entire annular combustion chamber 2 on the inside. The outer combustion chamber wall 10 that delimits annular combustion chamber 2 in the area between main burner 4 and combustion chamber end 8 can be shaped in accordance with the most favorable design. Here again it is recommended to use a pattern for wall section 6*c* that converges toward lengthwise axis 4*a* initially in the area that directly abuts main burner 4, while in the vicinity of combustion chamber end area 8 there must be a sufficient cross section for the gases that are escaping, and thus a pattern may be required that diverges relative to central axis 1.

Outer wall section 6*b* of pilot burner zone 5, in both FIG. 1 and FIG. 2, also extends in the same manner as the entire annular combustion chamber 2, namely essentially annularly, but this does not mean that the reduction in cross section of pilot burner zone 5 over essentially the entire annular combustion chamber 2 must be performed to the same degree all the way around, although this is quite possible. Instead, quasi-shell-shaped depressions can be provided only in the vicinity of main burner 4, in outer wall section 6*b* which otherwise runs essentially parallel to pilot burner lengthwise axis 3. This latter design is shown schematically in the lower half of FIG. 3, while the first design mentioned is shown in the upper half of FIG. 3, which shows schematically a view taken in the direction of arrow X from FIG. 2. While the reduction in cross section of pilot burner zone 5 is performed by shell-shaped depressions, the reduction in cross section of pilot burner zone 5 is provided primarily in the planes formed by lengthwise axes 4*a* of main burners 4 as well as central axis 1 of annular combustion chamber 2.

Especially in the embodiment shown in FIG. 1, wall section 13 of inner combustion chamber wall 11 that abuts deflecting section 12 downstream thereof and leads to combustion chamber outlet 8 is once again aligned essentially parallel to main burner axis 4*a* and/or essentially in the direction of central axis 1. This wall section 13 is therefore essentially once again a part of main burner zone 5' and/or the corresponding main combustion chamber. The pilot burner zone 5 on the other hand, looking in flow direction 7, terminates in the vicinity of deflecting section 12. In this pilot burner zone 5, a short distance upstream from deflecting section 12, mixed air streams (as shown by arrows 14) can be supplied both internally and externally a short distance upstream from main burner 4 through openings, not shown in greater detail, in combustion chamber wall 11.

Of course, the precise dimensions as well as the angles that individual wall sections 6*a*, 6*b*, 12, and 13 form with one another can be designed to be completely different from the embodiment shown without departing from the spirit and scope of the present invention. Similarly, additional variations from the embodiment shown are possible. Thus, a wide variety of fuel atomization concepts can be used for pilot burners 3 as well as for main burners 4, and similarly the openings and/or holes for mixed air streams 9 and 14 can be located differently. In addition, these mixed air streams 9, 14 can be supplied twisted (swirled) or not twisted, without this having enormous consequences as regards the significant advantages of the present invention, namely optimal mixing especially in main burner zone 5'.

What is claimed:

1. An axially staged annular combustion chamber of a gas turbine having a central axis, comprising:

a plurality of pilot burners arranged between inner and outer annular wall sections;

main burners having ends terminating downstream of said plurality of pilot burners and being located radially outward from said pilot burners in said combustion chamber, said main burners abutting a main burner zone having outer and inner combustion chamber walls which are both annular in shape and extend up to a combustion chamber outlet, said inner combustion chamber wall in an area of a pilot burner zone forming the inner annular wall section running essentially parallel to a pilot burner axis;

wherein said inner combustion chamber wall abuts the inner annular wall section, which forms the pilot burner zone and runs essentially in parallel to the central axis, said inner combustion chamber wall having a deflecting section which is convex-concave in shape and runs toward the main burner zone relative to the combustion chamber when viewed in a downstream direction; and wherein said deflection section, when viewed in a radial direction relative to a central axis, ends approximately at a radial level of the outer annular wall section and abuts a downstream wall section of the inner combustion chamber wall defining the main burner zone leading to the combustion chamber outlet.

2. The annular combustion chamber according to claim 1, wherein combustion gases from the plurality of pilot burners are guided by the deflecting section so as to enter the main burner zone essentially in a radial direction.

3. The annular combustion chamber according to claim 1, wherein the outer annular wall section of the pilot burner zone faces the main burners, said outer annular wall section extending at an angle relative to a lengthwise axis of an associated pilot burner, such that a cross section of the associated pilot burner zone is reduced in a flow direction.

4. The annular combustion chamber according to claim 2, wherein the outer annular wall section of the pilot burner zone faces the main burners, said outer annular wall section extending at an angle relative to a lengthwise axis of an associated pilot burner, such that a cross section of the associated pilot burner zone is reduced in a flow direction.

5. The annular combustion chamber according to claim 3, wherein the inner annular wall section is also arranged at an angle in an end area relative to the lengthwise axis such that the cross-section of the pilot burner zone is reduced in the flow direction due to convergent inner and outer annular wall sections.

6. The annular combustion chamber according to claim 4, wherein the inner annular wall section is also arranged at an angle in an end area relative to the lengthwise axis such that the cross-section of the pilot burner zone is reduced in the flow direction due to convergent inner and outer annular wall sections.

7. The annular combustion chamber according to claim 3, wherein a penetration depth size of the main burner into the pilot burner zone resulting from the reduced cross-section of the pilot burner zone, relative to a reduced cross-section of the pilot burner zone in the area of the pilot burner is within a range of 0.1 to 0.3.

8. The annular combustion chamber according to claim 5, wherein a penetration depth size of the main burner into the pilot burner zone resulting from the reduced cross-section of the pilot burner zone, relative to a reduced cross-section of the pilot burner zone in the area of the pilot burner is within a range of 0.1 to 0.3.

9. The annular combustion chamber according to claim 3, wherein the reduced cross-section of the pilot burner zone is primarily formed in planes containing a lengthwise main burner axes and the central axis of the annular combustion chamber.

10. The annular combustion chamber according to claim 5, wherein the reduced cross-section of the pilot burner zone is primarily formed in planes containing a lengthwise main burner axes and the central axis of the annular combustion chamber.

11. The annular combustion chamber according to claim 7, wherein the reduced cross-section of the pilot burner zone is primarily formed in planes containing a lengthwise main burner axes and the central axis of the annular combustion chamber.

12. The annular combustion chamber according to claim 3, wherein the reduced cross-section of the pilot burner zone is essentially provided all around the annular combustion chamber.

13. The annular combustion chamber according to claim 5, wherein the reduced cross-section of the pilot burner zone is essentially provided all around the annular combustion chamber.

14. The annular combustion chamber according to claim 7, wherein the reduced cross-section of the pilot burner zone is essentially provided all around the annular combustion chamber.

15. The annular combustion chamber according to claim 1, wherein said main burners and said plurality of pilot burners are staggered with respect to one another in a circumferential direction.

16. The annular combustion chamber according to claim 1, further comprising openings in the outer annular wall section and the inner combustion chamber wall through which air is provided, a downstream end of the pilot burner zone being defined by the supplied air.

17. The annular combustion chamber according to claim 1, wherein the downstream wall section runs substantially parallel to or slightly divergent from the central axis, leading to the combustion chamber outlet.

18. A combustion chamber wall arrangement of a gas turbine having a central axis and at least one pilot burner and a radially outwardly and downstream arranged main burner, comprising:

an inner combustion chamber wall including an inner wall section having an inner surface extending substantially parallel to both an associated burner axis and the central axis, a deflecting wall section having an inner surface with a convex-concave shape adjoining said inner wall section at a downstream end, and a final wall section adjoining said deflecting wall section at a downstream end at a greater radial distance from the central axis than the radial distance of said inner wall section, said final wall section forming a part of an associated burner zone and ending at a combustion chamber outlet area; and an outer combustion chamber wall.

19. The combustion wall arrangement according to claim 18, wherein said outer combustion chamber wall comprises an outer annular wall section which, together with said inner wall section defines a further burner zone, said outer annular wall section being arranged at a radial distance from the central axis approximately at the same radial distance of said final wall section.

20. The combustion wall arrangement according to claim 19, wherein said outer annular wall section extends at an angle relative to a lengthwise axis of said defined further burner zone such that a cross-section of said defined further burner zone is reduced in a downstream flow direction.

21. The annular combustion chamber according to claim 18, wherein the downstream wall section runs substantially parallel to or slightly divergent from the central axis, leading to the combustion chamber outlet.

* * * * *